US005650193A

United States Patent [19]

Swain et al.

[11] Patent Number: 5,650,193

[45] Date of Patent: Jul. 22, 1997

[54] COATING METHOD HAVING PARTICULATE MATERIAL INTRODUCED FROM WITHIN THE GAP REGION BETWEEN APPLICATORS

[75] Inventors: Eugene A. Swain; Henry T. Mastalski, both of Webster; Nicholas M. Lamendola, Lima, all of N.Y.

[73] Assignee: Xerox Corporation, Stamford, Conn.

[21] Appl. No.: 711,145

[22] Filed: Sep. 9, 1996

[51] Int. Cl.[6] ..... B05D 1/12; B05C 11/00

[52] U.S. Cl. ..... 427/11; 427/180; 427/194; 118/219; 118/221; 118/233; 118/255; 118/258; 118/416; 118/308; 118/76; 118/77; 118/107; 118/110; 118/112; 118/113; 118/118

[58] Field of Search ..... 427/11, 180, 194; 118/216, 218, 219, 221, 232, 233, 255, 258, 416, 76, 77, 107, 110, 112, 113, 118, 308

[56] References Cited

U.S. PATENT DOCUMENTS 2,553,209 5/1951 Powers, Sr. ..... 118/110

4,741,918 5/1988 Nagybaczon et al. ..... 427/11

5,368,890 11/1994 Nagybaczon et al. ..... 427/249

5,494,520 2/1996 Lamendola et al. ..... 118/608

*Primary Examiner*—Shrive Beck

*Assistant Examiner*—David Maiorana

*Attorney, Agent, or Firm*—Zosan S. Soong

[57] ABSTRACT

There is disclosed a coating method involving a dispensing apparatus defining a particulate material exit opening including: (a) rotating a first applicator and an adjacent second applicator against a substrate, wherein the first applicator and the second applicator define a gap region therebetween; and (b) introducing particulate material into the gap region from the particulate material exit opening positioned at the gap region and moving a portion of the particulate material across the gap region to the substrate, wherein the rotation of the first applicator and the second applicator rubs the particulate material against the substrate.

9 Claims, 4 Drawing Sheets

COATING METHOD HAVING PARTICULATE MATERIAL INTRODUCED FROM WITHIN THE GAP REGION BETWEEN APPLICATORS

BACKGROUND OF THE INVENTION

This invention relates to a coating method employing a novel particulate material feed system. The high speed coating process described in for example Nagybaczon et al., U.S. Pat. No. 4,741,918 requires that the particulate material be applied to the substrate in a uniform and controlled manner. Because of the turbulence caused by the high speed of the rotating applicator, it is difficult to apply the particulate material in an efficient and uniform manner. Thus, there is a need, which the present invention addresses, for new coating methods that apply particulate material to the substrate in a uniform and controlled manner.

In addition to the patent disclosed above, the following documents illustrate other known coating methods and apparatus: Lamendola et al., U.S. Pat. No. 5,494,520 and Nagybaczon, U.S. Pat. No. 5,368,890.

SUMMARY OF THE INVENTION

The present invention is accomplished in embodiments by providing a coating method involving a dispensing apparatus defining a particulate material exit opening comprising:

(a) rotating a first applicator and an adjacent second applicator against a substrate, wherein the first applicator and the second applicator define a gap region therebetween; and (b) introducing particulate material into the gap region from the particulate material exit opening positioned at the gap region and moving a portion of the particulate material across the gap region to the substrate, wherein the rotation of the first applicator and the second applicator rubs the particulate material against the substrate.

There is also provided in embodiments a coating method involving a dispensing apparatus defining a particulate material exit opening comprising:

(a) rotating a first applicator and an adjacent second applicator against a plurality of substrates, wherein the first applicator and the second applicator define a gap region therebetween having a peripheral edge, an interior area, and a central area; and (b) introducing particulate material into the gap region from the particulate material exit opening positioned at the central area and moving a portion of the particulate material across the gap region to the plurality of the substrates, wherein the rotation of the first applicator and the second applicator rubs the particulate material against the substrates.

BRIEF DESCRIPTION OF THE DRAWINGS

Other aspects of the present invention will become apparent as the following description proceeds and upon reference to the Figures which represent preferred embodiments.

Unless otherwise noted, the same reference numeral in different Figures refers to the same or similar feature.

DETAILED DESCRIPTION

Figure 1:
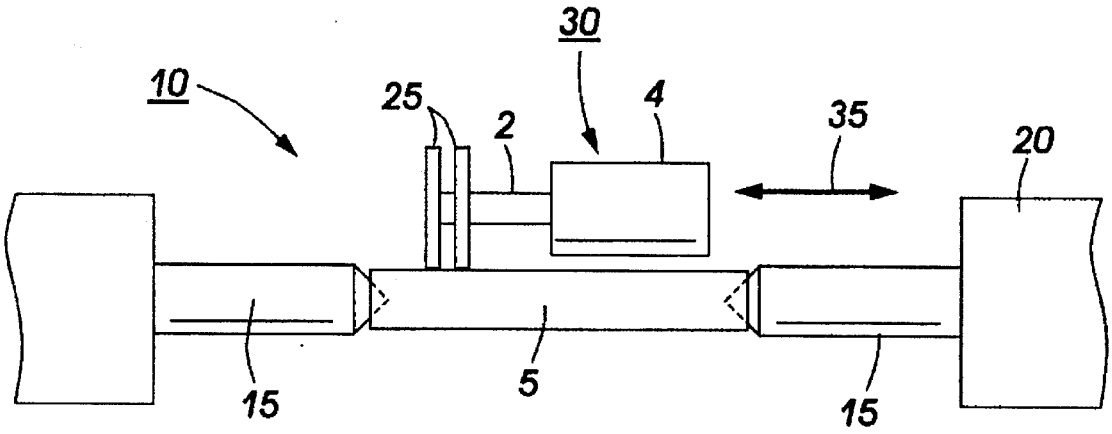
FIG. 1 is a schematic top view of representative equipment that may be used to accomplish the present invention.

In FIG. 1, substrate 5 is mounted on lathe 10 and is held by holding chucks 15. Motor drive 20 rotates substrate 5. The two applicators 25 which may be in the shape of a wheel (the applicators 25 are also referred herein as "wheels") are mounted on high speed rotation apparatus 30 (which includes a shaft 2 and a motor 4) so that the rim of applicators 25 contacts the surface of substrate 5. The rim of the applicators may contact the substrate surface at any effective angle, preferably wherein the plane of the wheel is perpendicular to the substrate surface. Applicators 25 and rotation apparatus 30 traverse substrate 5 along direction 35 while maintaining contact of the applicators 25 against the substrate. In embodiments, the bare or coated substrate may be mounted on any suitable device such as a lathe and rotated at an effective speed in either the clockwise or counterclockwise direction, preferably about 100 to about 3,000 rpm, and more preferably from about 200 to about 1,000 rpm.

Figure 2:
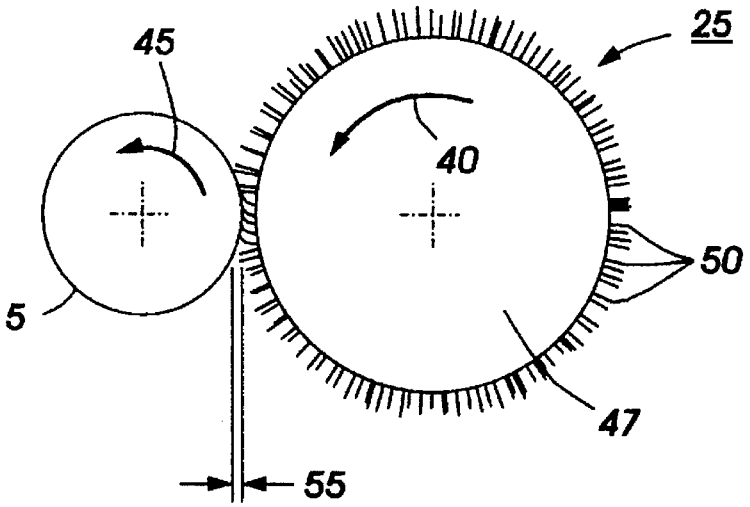
FIG. 2 is a schematic side view of the applicators being applied against the substrate.

FIG. 2 provides more detail on applicators 25 and substrate 5. The applicators 25 and substrate 5 preferably rotate in counter directions 40, 45 respectively. However, in embodiments, applicators 25 and substrate 5 may rotate in the same direction. The applicators 25 have two distinct areas. Bound region 47 is that portion which contains epoxy adhesive or other means such as stitching or clamping devices which join together the various layers of material that constitute the applicator. Fiber length 50 is that portion which is free of epoxy adhesive or other means that join the various layers of the applicator together. This free fiber length 50 is also referred to as "free material," "free fibers," or "edge region." The free fibers generally face radially outward. As applicators 25 contact the surface of substrate 5, the free fibers 50 at the area of contact impact the substrate, wherein the distance that the fiber's length impacts the substrate surface is described as interference 55. The extent of interference 55 may be of any effective length, preferably ranging from about 0.010 to about 0.050 inch, more preferably from about 0.010 to about 0.020 inch, and most preferably about 0.015 inch, where 0.0 inch is defined to be the point where the free fibers are just touching the substrate surface while at operating speed without any bending or compression of the free fibers at the point of contact. The applicators may be of any effective shape and are preferably disc-shaped.

In the present Figures, two adjacent applicators 25 define therebetween a gap region 6 having a central area 8, a peripheral edge 12, and an interior area 14 between the central area 8 and the peripheral edge 12. The precise dimensions of the peripheral edge, the interior area, and the central area may vary in embodiments.

Figure 3:
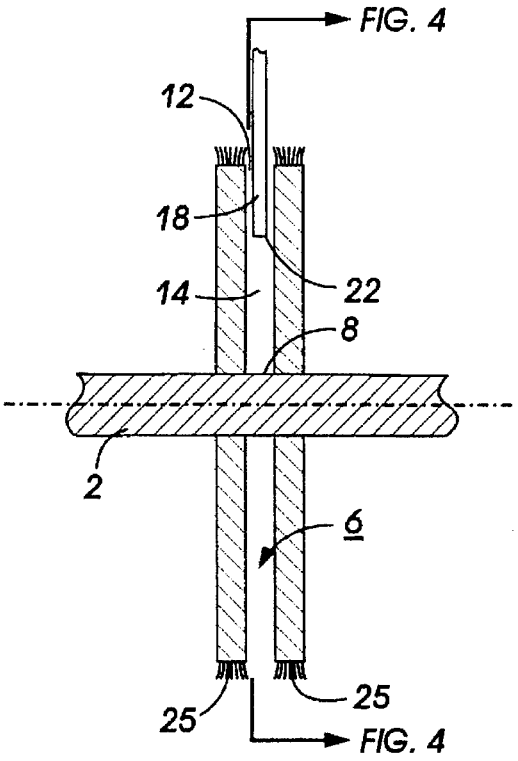
FIG. 3 is a schematic front view of one embodiment of representative apparatus that may be used to introduce particulate material into the gap region between adjacent applicators.
Figure 4:
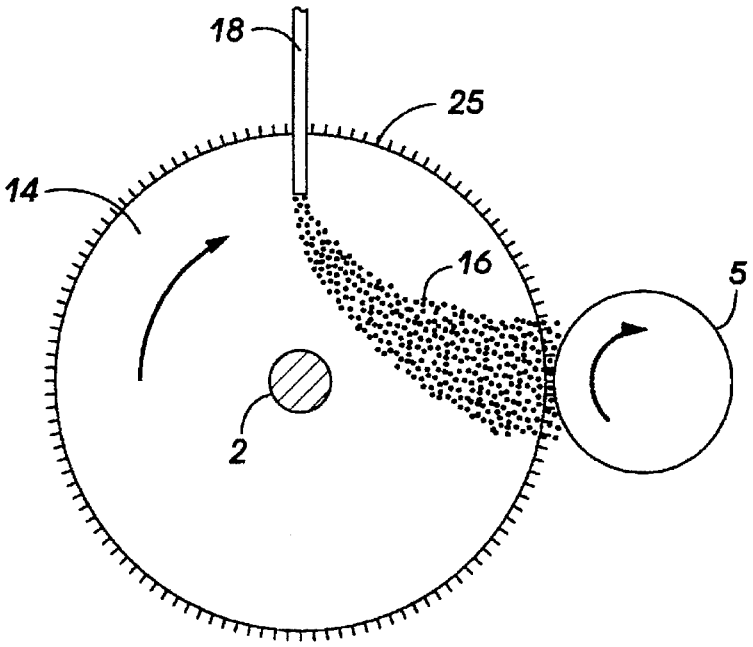
FIG. 4 is a schematic cross-sectional side view of the apparatus of FIG. 3.

FIGS. 3–4 illustrate one embodiment of the present invention where particulate material 16 is introduced into the interior area 14 via a dispensing apparatus 18, which may be a feed tube, extending through the peripheral edge 12 into the interior area 14 of the gap region 6. The particulate material exit opening 22 of the dispensing apparatus 18 may be positioned anywhere in the interior area 14 or even at the peripheral edge 12, but is preferably positioned such that during the present coating method a substantial portion of the particulate material is directed towards the substrate 5. In FIGS. 3–4, the applicators 25 are mounted on a shaft 2 which occupies the entire central area 8 of the gap region. The shaft 2 rotates the applicators 25 in the same direction, preferably clockwise. In embodiments of the present invention, a plurality of dispensing apparatuses (in the form of for example feed tubes) such as two, three, or more may be employed, wherein such dispensing apparatuses extend through different locations of the peripheral edge into the interior area of the gap region, resulting in the particulate material exit openings of the plurality of the dispensing apparatuses being disposed in a variety of locations in the interior area. The embodiment of FIGS. 3–4 produces a more localized, uniform dispersion of particulate material.

Figure 5:
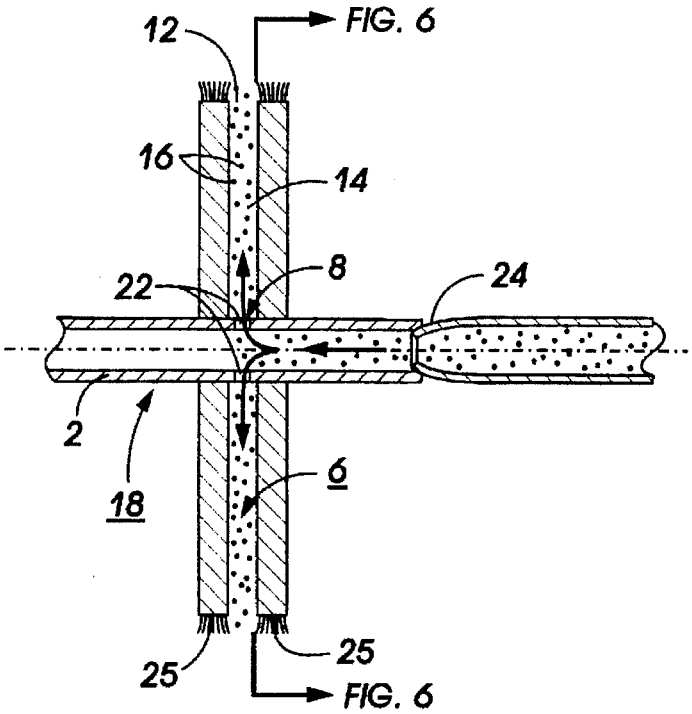
FIG. 5 is a schematic front view of another embodiment of representative apparatus that may be used to introduce particulate material into the gap region between adjacent applicators.
Figure 6:
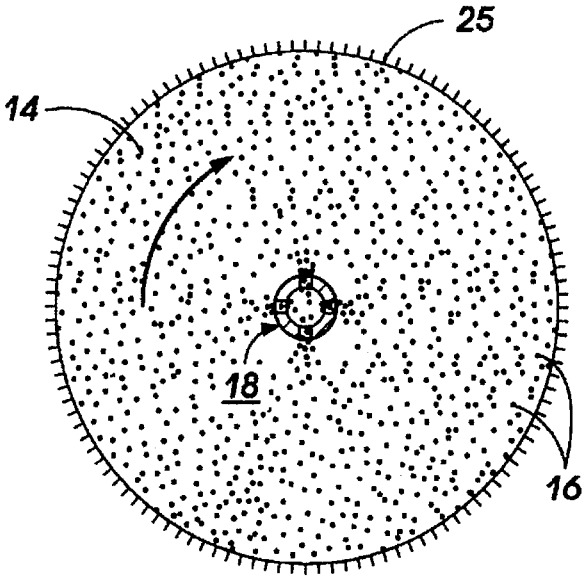
FIG. 6 is a schematic cross-sectional side view of the apparatus of FIG. 5.

FIGS. 5–6 illustrate another embodiment wherein the particulate material exit opening 22 of the dispensing apparatus 18 is positioned at the central area 8 of the gap region 6. In this embodiment, the dispensing apparatus 18 includes a hollow shaft 2 and a feed tube 24 coupled to the shaft 2. The shaft 2 of the dispensing apparatus 18 includes one, two, three or more particulate material exit openings 22 to permit exit of the particulate material 16 into the interior area 14 of the gap region 6. Preferably, the one or more openings 22 are spaced around the periphery of the shaft 2. In this embodiment, the shaft 2 occupies the entire central area 8. The shaft 2 rotates the applicators 25 in the same direction, preferably clockwise. The embodiment of FIGS. 5–6 produces a uniform dispersion of particulate material 16 at all points around the peripheral edge 12 of the gap region.

Figure 7:
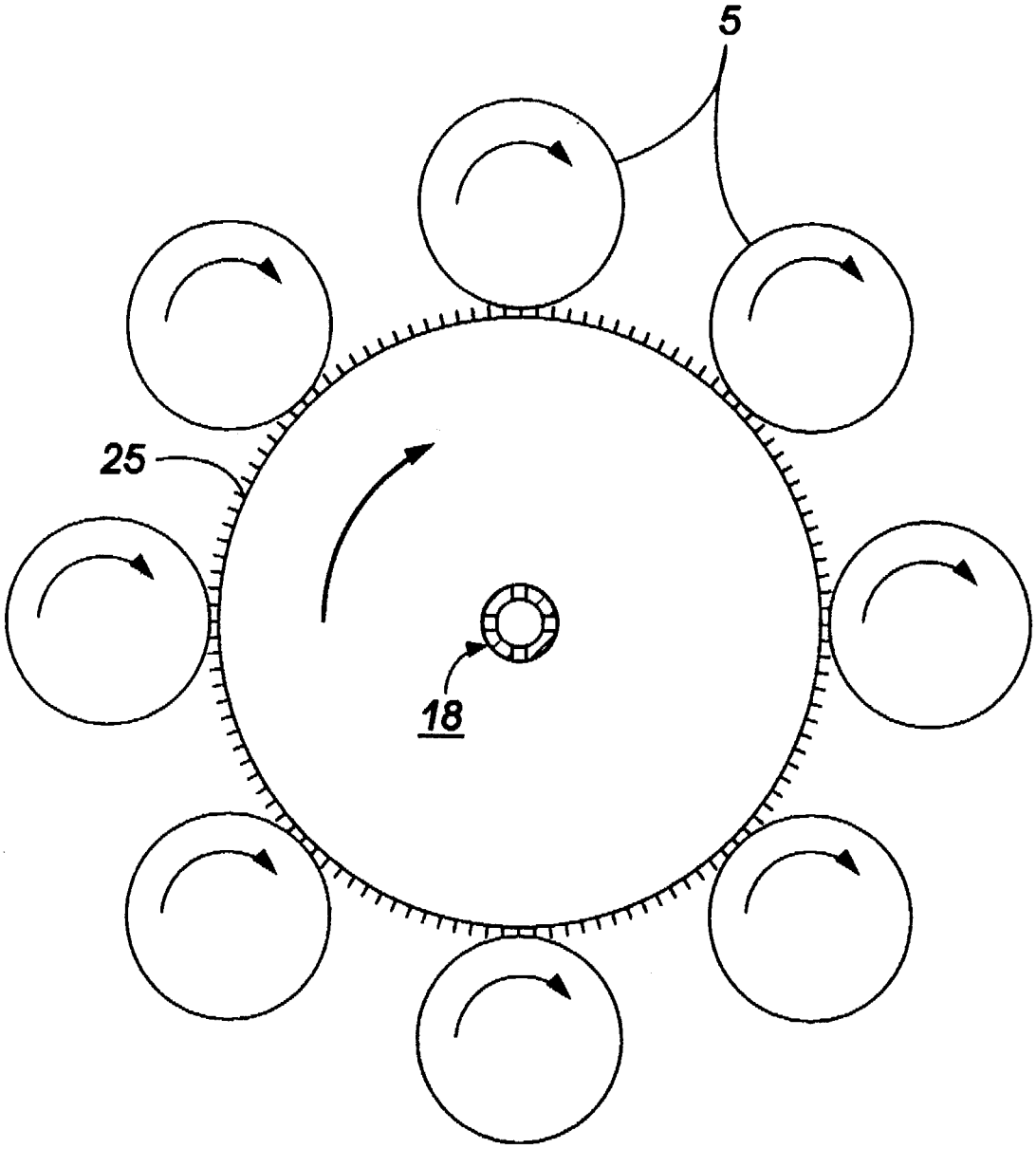
FIG. 7 is a schematic side view of the apparatus of FIG. 5 in contact with a plurality of substrates.

FIG. 7 depicts a high efficiency coating configuration using the embodiment of FIGS. 5–6 where the substrates 5 to be simultaneously coated are mounted on separate shafts and are arranged in a planetary configuration, preferably equally spaced, around the two applicators 25. The applicators 25 simultaneously contact all of the substrates 5. The number of substrates may range from 2 to 30, preferably from 8 to 25.

Features of the film coating apparatus described in Lamendola et al., U.S. Pat. No. 5,494,520, the disclosure of which is hereby totally incorporated by reference, such as the feeder and the jet mill may be employed in the present invention. The output of the jet mill to the instant dispensing apparatus consists of the particulate material having minimal or no agglomerations, which is substantially uniformly, preferably uniformly, dispersed in the carrier gas. The rate of particulate material introduced by the dispensing apparatus to the gap region ranges for example from about 10 to about 200 grams per hour, and preferably from about 50 to about 100 grams per hour.

The particulate material may be drawn into the gap region by the partial vacuum created by the high speed rotation of the applicators. The partial vacuum in the gap region created by the rotating applicators may be as high as for instance 10 inches of mercury, and preferably from about 3 to about 7 inches of mercury. In addition, the gas containing the particulate material can be pressurized to facilitate movement of the particulate material into the gap region. Pressures in the range of for example about 1 to about 20 pounds per square inch can be utilized but preferred pressures range from about 5 to about 10 pounds per square inch.

In the present invention, the rotation of the applicators causes a portion of the particulate material to move across the gap region to the substrate or substrates. The remainder of the particulate material is believed to adhere to the sides of the applicators, to move to the free fiber length 50 including the tips thereof, and/or to escape into the ambient environment. The particulate material within the interior area of the gap region is believed to move in a curved pattern due to the centrifugal force generated by the rotating applicators.

The present invention provides the following benefits: very uniform flow of particulate material to the gap region which results in very uniform deposits of particulate material onto the free fibers of the applicator. This is a result of the flow of particles outwardly from the center of the applicator and into the path of the violently vibrating free fibers on both sides of the gap region. This uniform distribution of particulates onto the free fibers results in a more uniform coating and a capability to increase the traverse speed of the applicator resulting in a faster coating speed. In addition, this uniform free fiber coverage is uniform over the total periphery of the applicator resulting in the capability to employ multiple substrate coating as described herein.

The present invention is described in the context of a pair of applicators, but the present method is suitable for a plurality of applicators such as three, four, five or more, wherein the applicators are spaced adjacent to one another with adjacent applicators defining a gap region therebetween. The gap region between adjacent applicators may have a width of from about 3 mm to about 20 mm, and preferably from about 5 mm to about 10 mm.

For simplicity, the characteristics of the applicators are described in the context of one applicator, but such characteristics also pertain to all applicators employed in the present invention.

The peripheral surface speed of the applicator is determined by the following formula: surface speed=(rotation speed)×(wheel diameter)×pi. Rotation speed is measured in revolutions per minute ("rpm"). The surface speed, the rotation speed, and the wheel diameter may be any suitable value for depositing the coating on the substrate surface. In embodiments, the surface speed of the applicator is at least about 1,000 ft/min. The applicator surface speed may be at least about 8,000 ft/min, preferably from about 10,000 to about 60,000 ft/min, more preferably from about 20,000 to about 60,000 ft/min, and most preferably from about 25,000 to about 50,000 ft/min. The applicator may rotate in embodiments at a speed of from about 10,000 to about 400,000 rpm, preferably from about 15,000 to about 100,000 rpm, and more preferably from about 30,000 to about 80,000 rpm. In embodiments, the wheel diameter is from about ¾ to about 12 inches, preferably from about 1 to about 8 inches, and more preferably from about 2 to about 6 inches. The applicator may have a free fiber length of from about 1/16 to about 2 inches, and preferably ⅛ to about ½ inch. The applicator has a width of any effective value, preferably from about 1/16 to about 2 inches, more preferably ⅛ to about ½ inch. In embodiments of the present invention, the rotation speed and surface speed of the applicator are sufficiently high to enable the free fibers of the applicator to "flare out." The phenomenon of "flare out" is generally evidenced by a change in noise pitch and a slight drop in rotational speed and is believed to be caused when air currents, generated by the rapidly rotating applicator, fluff the free fibers and cause them to vibrate. "Flare out" of the free material of the applicator is desired since it is believed to facilitate at least in part the deposition of the coating on the substrate surface.

"Flare out" of the free fibers, however, is not necessary in every instance.

Several embodiments of the applicator permit an increase in the width of the surface that can be rubbed and therefore an increase in traverse speed. In one embodiment, the wobble wheel, there is provided any effective means to enable the wheel to wobble or oscillate as it rotates. It is believed that an oscillating wheel will rub a larger surface width than a rigidly mounted rotating wheel. This may be accomplished, for example, by attaching a wedge shaped washer to each side of the buffing wheel. In a second embodiment, the wavy wheel, there is provided a buffing wheel wherein the rim thereof is contoured into an undulating form. The wavy wheel may be made, for example, by taking the epoxy bonded wheel out of the die early, before the epoxy hardens, so that the wheel is soft and pliable. The wheel is then placed into a die with bias spacers positioned at appropriate intervals which offsets the rim from the plane of the wheel into a number of arc-shaped contours. The epoxy in the wheel is then allowed to harden, yielding the wavy wheel.

The applicators may be in the shape of a roller or wheel. Each applicator is shorter in length than the substrate and the applicator traverses across the length of the substrate to apply the particulate material at a traverse speed ranging for example from about 1 to about 10 mm/minute, preferably from about 3 to about 8 mm/minute, and especially about 5 mm/minute. A housing (not shown), which may be closed on both ends, can encompass the applicators. The distance between the housing and the applicator surface may range for example from about 1 to about 20 mm, preferably from about 3 to about 10 mm, and especially about 5 mm.

An applicator for use in the method of the invention is a jeweler's buffing wheel. Suitable buffing wheels include those available from W. Canning Materials Limited, Great Hampton Street, Birmingham, England. These buffing wheels generally comprise a plurality of fabric discs clamped together in a way which allow the density of fabric at the periphery of the wheel to be adjusted. In embodiments of the present invention, each applicator may be made for example from sheets of cotton fabric cut in 10 cm diameter discs with a hole in the center of each disc of 2.5 cm diameter. These cotton discs are then pulled onto a threaded steel shaft of 2.5 cm diameter and are retained by 6 mm thick steel washers of 8.9 cm diameter to form an applicator 30 cm wide. The washers in turn are retained by suitable nuts. The cotton discs are compacted by tightening the retaining nuts to produce a density at the perimeter face of the compacted cotton mass appropriate to the material to be coated.

The preferred applicator is made from sheets of high purity cotton fabric cut into 30 cm diameter discs. A number of these discs, preferably 12, are layered so that every other disc has its weave at an angle of 45 degrees to each other. The layers are then placed in a two piece mold specially designed to allow low viscosity epoxy to be injected, which results in a hub made up of cotton reinforced epoxy. The hub diameter (preferably 25 cm in diameter) is less than the diameter of the discs thereby allowing the discs to have for example 2.5 cm in length of free fibers. The applicator can also include other layers of material to reinforce the applicator enabling it to withstand the high speeds of rotation. Material such as KEVLAR™ or graphite, preferably 3 layers of KEVLAR™ distributed uniformly among the cotton layers, are included in the composition of the applicator.

The particulate material (also referred herein as "coating material") is rubbed across the surface of the substrate by the applicator having a resilient surface which is in sliding contact with the substrate. The coating material can be selected from an enormous variety of materials. For example, it may be an organic polymer. Illustrative examples include; polyolefins such as polyethylene, polypropylene, polybutylene and copolymers of the foregoing; halogenated polyolefins such as fluorocarbon polymers; polyesters such as polyethyleneterephthalate; vinyl polymers such as polyvinylchloride and polyvinyl alcohol; acrylic polymers such as polymethylmethacrylate and polyethylmethacrylate; and polyurethanes. Alternatively, the coating material may be a metal such as gold, silver, platinum, iron, aluminium, chromium or tantalum. Further examples of suitable coating materials include magnetic oxides such as magnetic iron oxide and magnetic chromium dioxide, minerals such as quartz, organic and inorganic pigments, and even such materials as diamond and china clay. Yet, further examples include metalloid elements such as phosphorus, silicon, germanium, gallium, selenium and arsenic, optionally doped with other materials to confer desired semiconductor properties. If desired, mixtures of different kinds of particles may also be used.

Products which may be made by the invention include magnetic recording media and electrical components having conducting resistive, dielectric or semiconducting layers thereon. Other applications include the formation of protective coatings, decorative coatings, sizing coatings, key coats, light or heat absorbing coatings, light or heat reflective coatings, heat conducting coatings, slip coatings, non-slip coatings, anti-corrosion coatings, anti-static coatings and even abrasive coatings on substances such as metal, paper, glass, ceramics, fabrics and plastics. A preferred use for the invention is for the application of layered material during the fabrication of a photoreceptor. Preferred layered materials are photogenerating materials. Illustrative photogenerating materials include inorganic photoconductive particles such as amorphous selenium, trigonal selenium, and selenium alloys including for instance selenium-tellurium, selenium-tellurium-arsenic, selenium arsenide and mixtures thereof, and organic photoconductive particles such as various phthalocyanine pigments such as the X-form of metal free phthalocyanine described in U.S. Pat. No. 3,357,989, the disclosure of which is totally incorporated by reference, metal phthalocyanines such as vanadyl phthalocyanine and copper phthalocyanine, dibromoanthanthrone, squarylium, quinacridones available from DuPont under the tradenames Monastral Red, Monastral Violet and Monastral Red Y. Pigments also include dibromoanthanthrone pigments available from Imperial Chemical Industries under the tradenames Vat Orange 1 and Vat Orange 3, benzimidazole perylene, substituted 2,4-diamino-triazines disclosed in U.S. Pat. No. 3,442,781, the disclosure of which is totally incorporated by reference, and polynuclear aromatic quinones available from Allied Chemical Corporation under the tradenames Indofast Double Scarlet, Indofast Violet Lake B, Indofast Brilliant Scarlet, Indofast Orange, and the like. Polymers such as polymethacrylate, 2-hydroxy ethyl methacrylate, a series of nylons and polyesters can be applied as blocking layers in addition to inorganic oxides such as zirconium oxide silicon dioxide, and the like.

The particles of coating material will generally be less than 100 microns in size. However, the most appropriate particle size will depend to some extent on the chemical nature of the coating material and on the physical and chemical nature of the substrate. Usually, the particles will have a maximum diameter of less than 50 microns and more usually a maximum diameter less than 30 microns. For example, the particles may have a maximum diameter of from 0.5 to 30 microns, such as from 1 to 10 microns.

The particles of coating material may be delivered to the surface of the applicator or the substrate in the dry state, for example in a gas stream. It may be possible in embodiments to deliver the particles to the surface of the applicator or substrate in the form of a liquid dispersion, such dispersions being readily controllable. Preferably, the dispersing liquid is sufficiently volatile to evaporate almost instantly, leaving the particles in a substantially dry state. A suitable dispersing liquid is trichlorotrifluoroethane, though other low-boiling halogenated hydrocarbons can also be used, as can other liquids such as water.

The method of the invention can be used for coating virtually any substrate, whether flexible or rigid, smooth or rough. The substrate may be a flexible or rigid cylinder, preferably hollow, fabricated for example from a metal such as nickel, steel, aluminum, and the like. The process may be also used to great advantage for coating paper and woven and nonwoven fabrics (whether of natural fibers such as cellulosic fibers, or synthetic fibers such as polyesters, polyolefins, polyamides and substituted celluloses) and other materials of a soft nature. The coatings can be formed using a wide range of process conditions, which are all dependent on each other. Thus, when the applicator is in the form of for example a wheel which is used to rub particles of coating material across the substrate, the pressure applied by the wheel, the area of contact between the wheel and the substrate, the peripheral speed of the wheel, and the relative speed between the surface of the wheel and the substrate may all be varied. However, alteration of any one of these parameters may require that one or more of the other parameters be adjusted in order to compensate.

In addition, of course, the conditions which are appropriate for forming a coating of a given material on a given substrate may not be appropriate for coating a different substrate or for coating with a different coating material. In all cases, however, the appropriate process conditions will be readily determinable by the person skilled in the art.

Generally, the more delicate the substrate, the lower the pressure with which the particles of coating material should be pressed against the substrate, in order to avoid damage thereto. Thus, for example, a very lightweight nonwoven fabric may be coated with plastic materials using a 30 cm diameter soft fabric applicator wheel, by training the fabric round the wheel, and applying only a slight tension (e.g., from 10 to 100 grams/cm width of fabric, depending on the strength of the fabric). With this arrangement, the pressure with which the wheel bears against the fabric is very low indeed, for example from less than 1 g/cm$^2$ to a few grams/cm$^2$. However, such low pressures are compensated for by the fact that the individual particles of coating material are drawn over a very substantial length of the nonwoven fabric, such as from one quarter to three quarters of the circumference of the wheel. When relatively sturdy substrates are used, it may be appropriate to use still larger contact pressures between the applicator and the substrate. For example, pressures greater than 1 kg/cm$^2$ may be appropriate for coating metals with other relatively hard materials (such as metals, metal oxides, and the like). Dynamic pressures of from 2 to 100 kg/cm$^2$ are most frequently used for this kind of coating, for example from 5 to 50 k/cm$^2$.

Although the factors which determine the appropriate coating conditions for different substrates are imperfectly understood, it will be apparent that identifying the appropriate conditions for a given substrate is merely a matter of trial and error. The operator need only choose a coating technique which is appropriate to the strength and flexibility of the substrate in question, and then increase the applicator pressure and/or applicator speed until a desired coating is formed.

Moreover, in each case the coating formed is very thin, but nonetheless highly adherent, non-granular in appearance and substantially free of micropores. Even in cases when the coating material had a very high melting point, the coating may have a characteristic smeared appearance under high magnification scanning electron microscopy, strongly suggesting plastic deformation of the particles of coating material at the time of film formation.

The coatings formed by the method of the present invention have a number of important characteristics. Firstly, they are very thin, being less than for example 3 microns in thickness. More usually, they are substantially thinner than this, very often being less than 500 nm thick and often less than 200 nm thick. Typical film thicknesses are from 1 to 100 nm thick, preferably from 5 to 50 nm thick. A most unusual characteristic of the process of the invention is that in embodiments, the coatings produced thereby are effectively self-limiting in thickness, in the sense that the coating, once formed, will generally not increase in thickness even when more of the same coating powder is rubbed over the surface. Another preferred characteristic of the films formed by the process of the invention is that they may be substantially nonporous. This is highly unusual in such thin coatings. Yet a further characteristic of the coatings formed by the method of the invention is that they are generally substantially free of voids. This is in marked contrast to the coatings formed by many prior art techniques, such as sputtering. Also, coatings produced by the instant invention are substantially uniform, preferably uniform, in thickness over very large areas of surface such as 800 cm$^2$ as revealed by visual inspection.

Additional details of the process to coat particulate material onto the substrate are provided in Nagybaczon et al., U.S. Pat. No. 4,741,918, the disclosure of which is totally incorporated by reference.

Other modifications of the present invention may occur to those skilled in the art based upon a reading of the present disclosure and these modifications are intended to be included within the scope of the present invention.

We claim:

1. A coating method involving a dispensing apparatus defining a particulate material exit opening comprising:

(a) rotating a first applicator and an adjacent second applicator against a rotating substrate, wherein the first applicator and the second applicator define a gap region therebetween, wherein the particulate material exit opening is positioned at the gap region; and (b) introducing particulate material into the gap region from the particulate material exit opening and moving a portion of the particulate material across the gap region to the substrate, wherein the rotation of the first applicator and the second applicator rubs the particulate material against the substrate.

2. The coating method of claim 1, wherein the gap region defines a peripheral edge, an interior area, and a central area, and positioning the particulate material exit opening at the interior area of the gap region.

3. The coating method of claim 1, wherein the gap region defines a peripheral edge, an interior area, and a central area, and positioning the particulate material exit opening at the central area.

4. The coating method of claim 1, wherein the first applicator and the second applicator are rotated at a peripheral surface speed of at least about 1,000 ft/min.

5. The coating method of claim 1, wherein the first applicator and the second applicator are rotated at a peripheral surface speed ranging from about 10,000 to about 60,000 ft/min.

6. The coating method of claim 1, wherein the first applicator and the second applicator are rotated at a speed ranging from about 10,000 to about 400,000 rpm.

7. The coating method of claim 1, further comprising moving the first applicator and the second applicator along the length of the substrate.

8. The coating method of claim 1, wherein the first applicator and the second applicator are rotated at a speed ranging from about 15,000 to about 100,000 rpm.

9. A coating method involving a dispensing apparatus defining a particulate material exit opening comprising:

(a) rotating a first applicator and an adjacent second applicator against a plurality of substrates, wherein the first applicator and the second applicator define a gap region therebetween having a peripheral edge, an interior area, and a central area; and (b) introducing particulate material into the gap region from the particulate material exit opening positioned at the central area and moving a portion of the particulate material across the gap region to the plurality of the substrates, wherein the rotation of the first applicator and the second applicator rubs the particulate material against the substrates.

* * * * *